United States Patent [19]

Honegger

[11] Patent Number: 4,732,374

[45] Date of Patent: Mar. 22, 1988

[54] APPARATUS FOR COLLATING FOLDED PRINTED PRODUCTS, ESPECIALLY SIGNATURES OR SHEETS

[75] Inventor: Werner Honegger, Tann-Rüti, Switzerland

[73] Assignee: Ferag AG, Hinwil, Switzerland

[21] Appl. No.: 889,221

[22] Filed: Jul. 25, 1986

[30] Foreign Application Priority Data

Jul. 31, 1985 [CH] Switzerland ..... 3311/85

[51] Int. Cl.[4] ..... B65H 5/30

[52] U.S. Cl. ..... 270/55; 271/277; 271/314

[58] Field of Search ..... 270/53-58; 271/277, 314

[56] References Cited

U.S. PATENT DOCUMENTS

| | | | |
|---|---|---|---|
| 2,626,074 | 1/1953 | Vogt | 270/54 |
| 3,096,089 | 7/1963 | Swenker et al. | 270/58 X |
| 3,420,516 | 1/1969 | Guggisberg | 270/55 |
| 3,951,399 | 4/1976 | Reist | 270/58 |

FOREIGN PATENT DOCUMENTS

| | | | |
|---|---|---|---|
| 3200594 | 7/1983 | Fed. Rep. of Germany | 270/55 |
| 176901 | 3/1922 | United Kingdom | 270/54 |

*Primary Examiner*—E. H. Eickholt

*Attorney, Agent, or Firm*—Werner W. Kleeman

[57] ABSTRACT

The collating apparatus comprises a plurality of collating or collecting conveyors or product advancing means revolvingly driven about the axis of revolution of the collating apparatus. These collating conveyors are pivotably mounted at each end face of the collating apparatus in control levers or rocker arms. These rocker arms are pivotably mounted on two disc-shaped supporting or support elements. These support elements are mounted in mutual axial separation on a shaft of the collating apparatus rotatably driven about the axis of revolution. The control levers or rocker arms support control rollers or followers which travel in guide grooves of guide or control curves or cams. The control curves or cams are constructed such that the rocker arms together with the collating conveyors are pivoted inwardly and subsequently are again pivoted outwardly relative to the axis of revolution of the collating apparatus during its revolution. In this manner an accommodation of the distances between adjacent collating conveyors to operational requirements is possible.

26 Claims, 4 Drawing Figures

APPARATUS FOR COLLATING FOLDED PRINTED PRODUCTS, ESPECIALLY SIGNATURES OR SHEETS

CROSS REFERENCE TO RELATED APPLICATIONS

The present invention is related to the commonly assigned United States patent application Ser. No. 877,359, filed June 23, 1986, and entitled "METHOD AND APPARATUS FOR COLLATING FOLDED PRINTED PRODUCTS, ESPECIALLY SIGNATURES OR SHEETS", The disclosure of which is incorporated herein by reference, now U.S. Pat. No. 4,684,116, granted Aug. 4, 1987, and the commonly assigned United States patent application Ser. No. 877,360, filed June 23, 1986 and entitled "METHOD AND APPARATUS FOR OPENING PRINTED PRODUCTS WHICH HAVE BEEN FOLDED OFF-CENTER" now U.S. Pat. No. 4,684,117, granted Aug. 4, 1987.

BACKGROUND OF THE INVENTION

The present invention broadly relates to a new and improved apparatus for collating folded printed products, especially signatures or sheets.

In its more particular aspects, the present invention concerns a new and improved apparatus for collating folded printed signatures or sheets in which the printed signatures or sheets are delivered in a straddling manner to and deposited upon a collating conveyor or upon the most recently delivered printed signature or sheet to have been previously deposited thereupon.

Known apparatuses for collating printed signatures or sheets, as described, for example, in the Swiss Pat. No. 412,795, have a plurality of deposit stations arranged along a collating conveyor. The folded printed signatures are removed from a stack, opened and deposited in a straddling manner on the collating conveyor or on the previously deposited printed signature which is already present on the collating conveyor at this location. Since each printed signature must be individually removed from a stack, it is not possible to arbitrarily increase the operational speed of such apparatuses. Furthermore, the printed signatures, which as a rule leave the rotary printing press in an imbricated formation, must first be formed into a stack which then must be brought to the deposit stations. This requires, however, a significant expenditure of time, infrastructure, equipment and/or manpower.

These disadvantages are substantially eliminated by an apparatus known from the European Patent Publication No. 0,095,603, published Dec. 7, 1983 and corresponding to the U.S. Pat. No. 4,489,930, granted Dec. 25, 1984. In this known apparatus, the printed products are fed continuously, i.e. directly in the arriving formation, to the collating conveyor. Consequenatly, the printed products do not have to be stacked up into a stack as was previously the case. This apparatus, however, has the disadvantage of a relatively great structural length since its feeders have the same feeding direction as the collating conveyors at least in the transfer or delivery region of the folded printed signatures or sheets. The collating conveyors transport the printed signatures or sheets in a direction which is transverse or approximately at right angles to their folded edge.

Moreover, it is not possible to increase the operational speed of this apparatus in the amount desired.

From the previously mentioned related and commonly assigned United States patent application Ser. No. 877,359, filed June 23, 1986, and entitled "METHOD AND APPARATUS FOR COLLATING FOLDED PRINTED PRODUCTS, ESPECIALLY SIGNATURES OR SHEETS", now U.S. Pat. No. 4,684,116, granted Aug. 4, 1987, an apparatus is known which comprises collating conveyors arranged in an annular array about an axis of revolution and mounted in a support frame to form a collating cylinder. The direction of conveyance of these product collating conveyors or produce advancing means is substantially parallel to the axis of revolution of the collating cylinder and these collating conveyors are revolvingly driven about this axis of revolution. The spaces or distances between each of the adjacent collating conveyors remain constant during rotation. These spaces or distances must, on the one hand, be large enough that the collating conveyors can move past one another in an unobstructed fashion during their revolution about the longitudinal axis of the collating apparatus. On the other hand, these distances are to be matched or coordinated to the mutual distance or spacing of the printed signatures or sheets which are delivered in an imbricated formation and deposited onto the collating conveyors.

SUMMARY OF THE INVENTION

Therefore, with the foregoing in mind, it is a primary object of the present invention to provide a new and improved construction of an apparatus for collating folded printed products, especially signatures or sheets, which does not exhibit the aforementioned drawbacks and shortcomings of the prior art constructions.

Another and more specific object of the present invention aims at providing a new and improved apparatus of the previously mentioned type which permits collation of printed products, especially signatures or sheets, in the smallest possible space with a higher speed of operation than has hitherto been possible.

Yet a further significant object of the present invention aims at providing a new and improved apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus of the present invention for collating folded printed products, especially signatures or sheets, is manifested by the features that a plurality of collating conveyors is provided, each of the collating conveyors having a direction of conveyance and extending substantially parallel to a common axis of revolution. These collating conveyors are positioned or spaced around the axis of revolution. The printed signatures or sheets revolve about this axis of revolution during conveyance or advancement along the associated collating conveyor. Control means are provided for altering the distance or spacing between adjacent collating conveyors during their revolution about the axis of revolution of the collating apparatus.

In other words, the apparatus of the present invention is manifested by the features that each collating conveyor of the plurality of collating conveyors is arranged substantially parallel to a common axis of revolution, each collating conveyor being arranged in spaced relationship to the common axis of revolution. Rotary drive means are provided for driving the plurality of collating conveyors and for revolving the plurality of collating conveyors about the common axis of revolution and for simultaneously transporting the printed signatures or sheets in a direction of conveyance extending substantially parallel to the common axis of revolution. Control means are provided for regulating and changing the mutual distance or spacing between adjacent collating conveyors during the revolution of these collating conveyors about their common axis of revolution.

In view of the fact that a plurality of revolvingly driven collating conveyors are provided, several collating operations can be simultaneously performed. Each feeding device thus feeds several collating conveyors so that printed signatures or sheets can be delivered or deposited in rapid sequence at each loading or feeding position onto one of the individual collating conveyors without the necessity of correspondingly increasing the advance or feed speed of the collating conveyors. This is due to the fact that the period of a revolution of the collating conveyors about the common axis of revolution is substantially available for feeding the successive printed signatures or sheets. A relatively short construction or structural length in the direction of axial signature feed is possible in spite of the high degree of efficiency attained, since the printed signatures or sheets follow a path having the shape of a helix or coiled spiral.

By altering or regulating the mutual distance or spacing between adjacent ones of the collating conveyors during their revolution about the common axis of revolution, it is possible, on the one hand, for the collating conveyors to move past or relative to one another during their revolution without contacting one another and without the deposited printed signatures or sheets being damaged. On the other hand it is also possible for the collating conveyors to receive the printed signatures or sheets arriving in an imbricated formation without problem.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
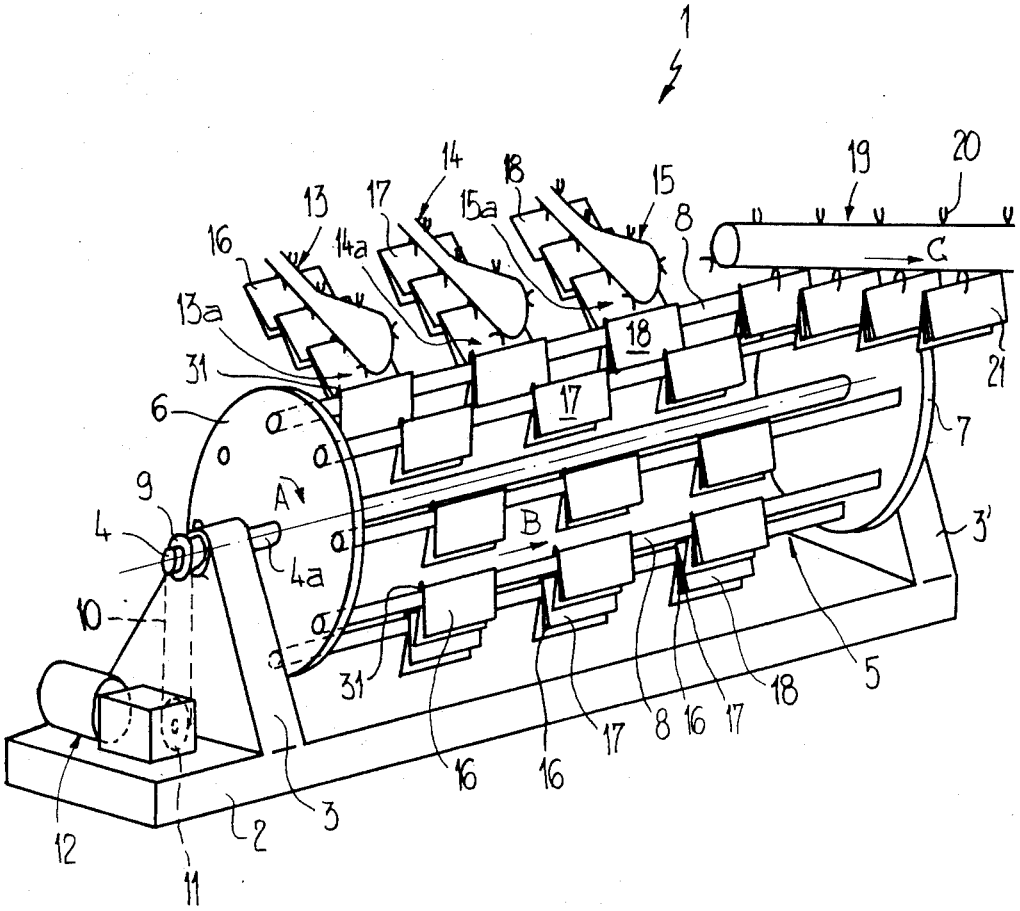
FIG. 1 is a perspective view of an exemplary embodiment of the collating apparatus.

Describing now the drawings, it is to be understood that to simplify the showing thereof only enough of the structure of the apparatus for collating folded printed products, especially signatures or sheets, has been illustrated therein as is needed to enable one skilled in the art to readily understand the underlying principles and concepts of this invention. Before proceeding to FIGS. 1 and 2 of the drawings, it will be noted that the collating apparatus 1 shown therein is only schematically illustrated. These schematic FIGS. 1 and 2 will be used to first describe the basic construction of this collating apparatus 1. A more detailed explanation of specific features will be presented in relation to FIGS. 3 and 4. Turning now specifically to FIG. 1 of the drawings, the collating apparatus 1 illustrated therein by way of example and not limitation will be seen to comprise a base plate or stand 2 having bearing pedestals or brackets 3 and 3' in which a shaft 4 of a collating drum or cylinder 5 is positioned.

Figure 2:
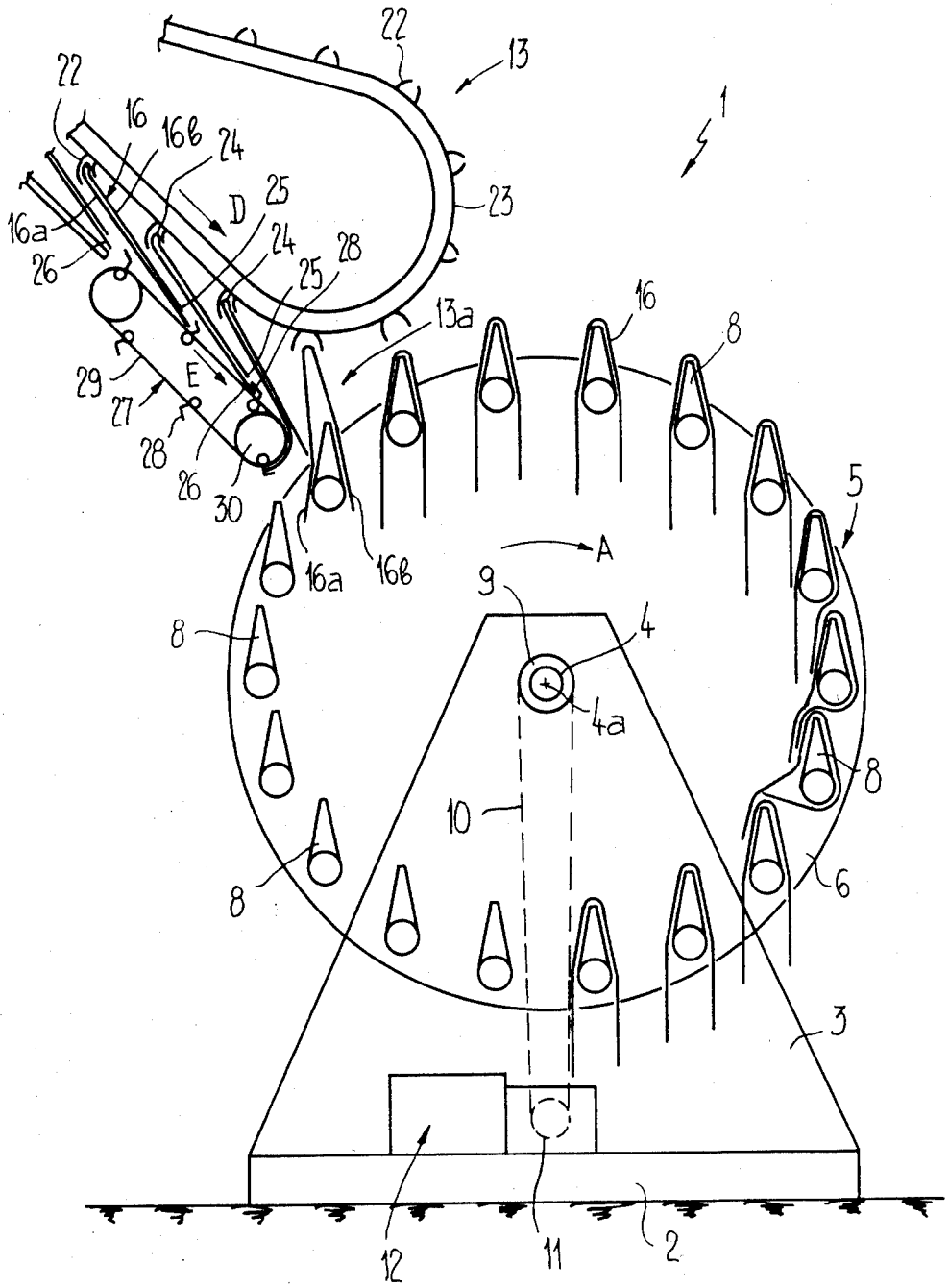
FIG. 2 is an end view of the collating apparatus and a feeding conveyor or infeed device or feeder shown on an enlarged scale relative to FIG. 1.

Turning now to FIG. 2, it will be assumed for the sake of illustration and ease of description that the bearing pedestal or bracket 3 is transparent. In FIG. 2, the rotatable supporting or support element 6 likewise will be assumed to be transparent. Two substantially parallel, discoidal, rotatable supporting or support elements 6 and 7 are mounted on the shaft 4 and mutually separated by a predetermined spacing as can be seen in FIG. 1. A plurality of product collating conveyors or product advancing means 8 is positioned between these two rotatable supporting or support elements 6 and 7. These collating conveyors 8 are pivotably arranged in the rotatable support elements 6 and 7 as will be further described hereinbelow in relation to FIGS. 3 and 4. Furthermore, these collating conveyors 8 are disposed substantially parallel to one another and to the shaft 4 of the collating drum or cylinder 5 and are substantially annularly positioned around the shaft 4.

A sprocket or sprocket wheel 9 is mounted on one end of the shaft 4. Substantially below this sprocket or sprocket wheel 9 there is situated a drive means 12 positioned on the base plate or stand 2. On a not particularly referenced drive shaft of this drive means 12 there is mounted a further sprocket or sprocket wheel 11 which is also positioned substantially below the sprocket or sprocket wheel 9. A chain 10 engages and travels around the periphery of these sprockets or sprocket wheels 9 and 11. The collating drum or cylinder 5 together with the collating conveyors 8 is rotationally or circularly, i.e. revolvingly, driven by means of the drive means 12 in the direction of revolution A about a common axis of revolution 4*a*.

A plurality of, for instance, three feeding conveyors or infeed devices or feeders 13, 14 and 15 for infeeding folded printed products such as signatures or sheets 16, 17 and 18, respectively, are positioned sequentially as seen in the direction of the longitudinal axis or common axis of revolution 4*a* of the shaft 4, i.e. also as seen in a direction of conveyance B of the collating conveyors 8. The feeding conveyors or infeed devices 13, 14 and 15 end or terminate in the vicinity of the outer circumference or periphery of the collating drum or cylinder 5. The region in the vicinity of the outer circumference or periphery of the collating drum or cylinder 5 located between the collating drum or cylinder 5 and the infeed devices 13, 14 and 15 defines respective transfer or delivery regions 13*a*, 14*a* and 15*a* for the folded printed signatures or sheets 16, 17 and 18, respectively. When viewed in the direction of conveyance B of the collating conveyors 8 there is positioned behind the final infeed device 15 a schematically illustrated product withdrawal device or conveyor 19. This product withdrawal device or conveyor 19 comprises, for instance, grippers or clamps 20 positioned with substantially equal mutual spacing or separation. These grippers or clamps 20 are circulatingly driven in the direction of rotation C. These grippers or clamps 20 grip finished or completely collated and assembled end products 21 each comprising a plurality of overlapping or interstuffed, i.e. mutually intercalated, folded printed signatures or sheets and transport these end products 21 to a further conventional processing station which is not here particularly shown since it does not constitute subject matter of the present invention.

As seen in FIG. 2, only the forwardmost feeding conveyor or infeed device or feeder 13 of the substantially indentically constructed feeding conveyors or infeed devices or feeders 13, 14 and 15 is illustrated. This infeed device 13, as well as the other substantially identical infeed devices 14 and 15, possessses mutually spaced grippers or clamps 22. These grippers or clamps 22 are connected to a not particularly shown traction or tension member which travels in a channel 23 and is circulatingly driven in the direction of rotation D. These grippers or clamps 22 grasp or hold the conveyed folded printed signatures or sheets 16, or the respective folded printed signatures or sheets 17 or 18, at their folded or spine edges or backbones 24. The folded printed signatures or sheets 16, and in like manner the respective folded printed signatures or sheets 17 and 18, are conveyed by means of the infeed device 13 (or by the respective infeed devices 14 and 15) such that open or fan edges 25 of the folded printed signatures or sheets 16 which are opposite to the folded or spine edges or backbones 48 lead as seen in the direction of conveyance D of the infeed device 13. The folded printed signatures or sheets 16 (and also 17 and 18) are not folded in the middle but are folded off-center such that a portion **16*a* of the folded printed signatures or sheets 16 which is lowermost in the arriving product formation is longer than the other portion 16*b* and therefore protrudes or extends beyond the other portion 16*b* at this open or fan edge 25. This leading or protruding section of the lowermost portion 16*a* of the folded printed signatures or sheets 16, the so-called marginal lap, is designated by reference numeral 26**.

A respective opening or spreading device 27 is positioned below the infeed device 13 and each of the other infeed devices 14 and 15. Each such opening device 27 comprises gripping member or grippers 28 positioned in substantially uniform mutual spacing or separation along a traction or tension member 29 which is circulatingly driven in the direction of rotation E. These gripping members or gripper 28 open rearwardly as seen in the direction of rotation E and serve to grip or hold the underlying or lowermost portion **16*a* of the folded printed signature or sheet 16 at the marginal lap 26**.

As soon as the printed signatures or sheets 16 with their leading marginal laps 26 arrive in the effective region of the gripping members or grippers 28, these gripping members 28 close. The marginal lap 26 which is held or gripped by the gripping member 28 is then rotated together with the associated gripping member 28 around a front guide wheel 30 for the traction or tension member 29. This results in the underlying or lowermost portion **16*a* of the printed signature or sheet 16 being separated from the other portion 16*b* of the printed signature or sheet 16 in the region of the marginal lap 26 as is shown in FIG. 2. A not particularly referenced opening or gap is thus formed between the underlying or lowermost portion 16*a* and the other portion 16*b* of the printed signature or sheet 16. A collating conveyor 8** now enters this opening or gap.

As previously described, the collating conveyor 8 is revolvingly driven in the direction of rotation A about the common axis of revolution **4*a*. When the printed signature or sheet 16 has been moved by the infeed device 13 in the direction of conveyance D such that the collating conveyor 8 which has now arrived between the underlying or lowermost portion 16*a* and the other portion 16*b* of the printed signature or sheet 16 by its rotation in the direction D, then the associated gripper or clamp 22 is opened and the printed signature or sheet 16 is released as is shown in FIG. 2. The printed signature or sheet 16 thus straddles the collating conveyor 8 and comes to rest on this collating conveyor 8** which has the shape of a saddle or peaked roof.

Each of these collating conveyors 8 comprises a circulatingly driven conveyor or advancing means which is schematically indicated in FIG. 1 by the therewith associated entrainment means 31, but not particularly shown in the remaining Figures. These conveyors or advancing means indicated in FIG. 1 have the schematically illustrated entrainment means 31 attached thereto for conveying or advancing the deposited printed signatures or sheets 16, 17 and 18 in the longitudinal direction of the collating conveyors 8, i.e. in the direction of conveyance B as can be seen in FIG. 1.

Figure 3:
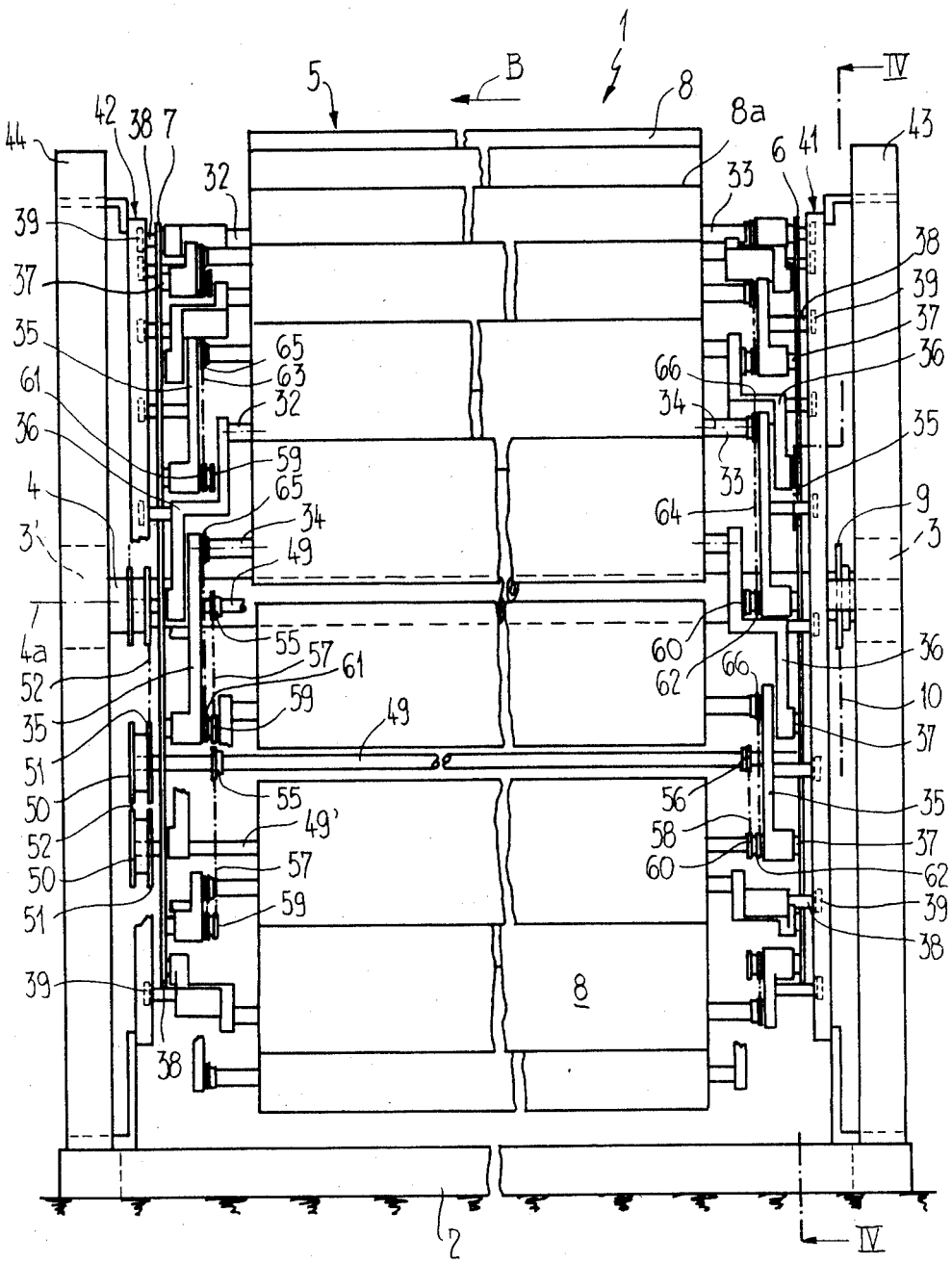
FIG. 3 is a side view of the collating apparatus shown on an enlarged scale relative to FIGS. 1 and 2.
Figure 4:
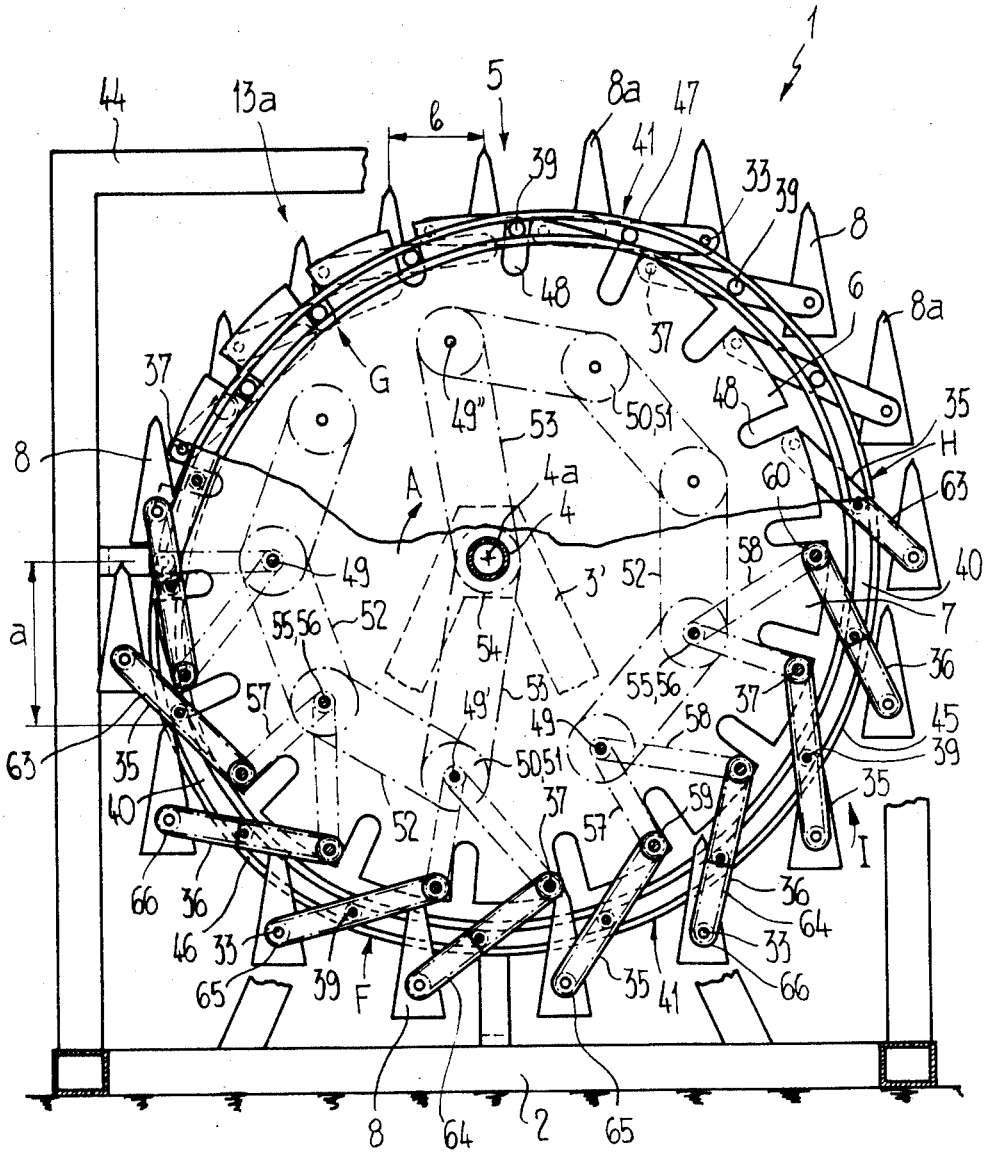
FIG. 4 is a section of the collating apparatus taken approximately along the line IV—IV in FIG. 3.

The arrangement of the collating conveyors 8 is further described hereinbelow with reference to FIGS. 3 and 4, wherein FIG. 4 shows a section through the collating apparatus 1 taken approximately along the line IV—IV in FIG. 3.

Each collating conveyor 8 is provided on each end face (in the vicinity of each support element 6 and 7) with projecting, pivotable or rotatable journals or journal pins 32 and 33. These journal pins 32 and 33 define an axis of rotation 34 for the associated collating conveyor 8. Each journal pin 32 and 33 is mounted at one end of a rocker arm or control lever 35 and 36, respectively, and is journaled therein. One of these rocket arms, namely the rocker arm or control lever 35, possesses a substantially straight or linear shape or form. The other rocker arm disposed opposite thereto and co-acting with the same collating conveyor 8, namely the rocker arm or control lever 36, is offset. Each collating conveyor 8 is therefore mounted or positioned at one side in a substantially straight rocker arm or control lever 35 and on the other side opposite thereto is positioned in an offset rocker arm or control level 36, as especially will be seen in FIG. 3.

The straight and offset rocker arms or control levers 35 and 36 alternate in their respective locations at the support elements 6 and 7. On each side of each collating conveyor 8 there is accordingly positioned or arranged a substantially straight rocker arm or control lever 35 between two offset rocker arms or controls levers 36, i.e. substantially straight and offset rocker arms 35 and 36, respectively, are alternately arranged one between the other. Each of the rocker arms or controls levers 35 and 36 is pivotably mounted on a pivot or journal pin 37 which is fastened or mounted on the supporting or support elements 6 and 7.

Between the mounting locations of the rocker arms or control levers 35 and 36 determined by the pivot or journal pins 37 and the mounting locations for the pivot or journal pins 32 and 33 of the collating conveyor 8 there projects outwardly an arm 38 from each rocker arm or control level 35 and 36. This arm 38 possessses at its end a guide or control roller or follower 39. This guide roller or follower 39 engages in a guide groove 40 of guide or control curves or tracks or cams 41 and 42, respectively, which are formed as substantially annular, i.e. basically ring-shaped, camming elements. Both guide or control curves or cams 41 and 42 are arranged on the outside of the supporting or support elements 6 and 7, respectively, and are fastened to frames or frame members 43 and 44, respectively. These frame or frame members 43 and 44 are, in turn, connected with the base plate or stand 2. The rocker arms or control levers 35 and 36 are arranged such that they project forwardly as seen in the direction of revolution of rotation A of the collating cylinder 5, as will be evident by reference to FIG. 4.

Both guide or control curves 41 and 42 comprise three sequentially adjacent sections, a first section 45, a second section 46 and a third section 47 (cf. FIG. 4). the first section 45 of both of the guide or control curves 41 and 42 is constructed in the shape of an arc or segment of a circle and is positioned substantially coaxial to the common axis of revolution 4*a* of the collating drum or cylinder 5. This first section 45 of the guide or control curves 41 and 42 is followed approximately at a first transition location or point designated by the reference character F by the second section 46 of both of the guide or control curves 41 and 42 as seen in the direction of revolution A of the collating drum or cylinder 5. The radial distance or spacing of this second section 46 to the common axis of revolution 4*a* constantly decreases as seen in the direction of revolution A. The third section 47 of the guide or control curves 41 and 42 begins approximately at a second transition location or point indicated with the reference character G and is followed by the first section 45 approximately at a third transition location designated by the reference character H. As seen in the direction of revolution A, the radial distance or spacing of the third section 47 of the guide or control curves 41 and 42 from the common axis of revolution 4*a* increases after the second transition location or point G.

Due to this configuration or design of the guide or control curves 41 and 42, the rocker arms or control levers 35 and 36 are pivoted inwardly in a clockwise direction, i.e. generally radially, towards the common axis of revolution 4a during the revolution of the collating conveyors 8 in the direction of rotation or revolution A as soon as the guide or control rollers or followers 39 of the rocker arms or control levers 35 and 36 have passed the first transition location or point indicated by the reference character F. In this manner the collating conveyors 8 are also pivoted in inwardly displaced. This inward pivoting motion or generally radial dispalcement causes a resulting reduction of the instantaneous speed of revolution of the collating conveyors 8 in the tangential direction at a given speed of rotation of the collating cylinder 5 because of the reduced radial distance or spacing from the common axis of revolution 4*a* with unchanged angular velocity. Furthermore, the circumferential or absolute distance or spacing between adjacent saddles or "roof peaks" of the collating conveyors 8 is increased. The greatest mutual distance or spacing is designated in FIG. 4 by the reference character a. As soon as the rocker arms or control levers 35 and 36 pass the second transition location or point designated by the reference character G with their guide or control rollers or followers 39, the rocker arms or control levers 35 and 36 again begin to pivot in a counterclockwise direction, i.e. generally radially, outwardly from the common axis of revolution 4*a*. This in turn results in the distance or spacing of the collating conveyors 8 from the common axis of revolution 4*a* again increasing and the speed of revolution of the collating conveyors 8 in the tangential direction again increases accordingly. The absolute mutual distance or spacing between adjacent collating conveyors 8 also simultaneosuly changes. In FIG. 4 the minimum mutual distance or spacing between adjacent saddles or "roof peaks" of the collating conveyors 8 is designated by the reference character b. While the guide control rollers or followers 39 pass through the first section 45 of the guide or control curves or cams 41 and 42, the collating conveyors 8 revolve with a substantially constant speed, i.e. constant angular velocity, about the common axis of revolution 4*a*.

The second transition location point G is located approximately in the transfer or delivery region 13*a* (or 14*a* and 15*a*, respectively) in which the printed signatures or sheets 16, 17 and 18 are deposited upon the collating conveyors 8 as is described in reference to FIGS. 1 and 2. The described design of the guide or control curves 41 and 42 provides a distance or spacing between adjacent collating conveyors 8 in this transfer or delivery region 13*a* which corresponds approximately to the separation distance or imbrication pitch of the printed signatures or sheets 16, 17 and 18 in the arriving imbricated formation. This separation distance or spacing of the printed signatures or sheets 16, 17 and 18 of the imbricated formation corresponds approximately to the minimum distance or spacing b between consecutive or successive collating conveyors 8. In this manner a problem-free transfer or delivery of the arriving printed signatures or sheets 16, 17 and 18 to the collating conveyors 8 is guaranteed. The speed of revolution of the collating conveyors 8 is reduced in this transfer or delivery region 13*a* which further contributes to the aforesaid situation. Outside of this transfer or delivery region 13*a* the mutual distance or spacing between adjacent collating conveyors 8 is greater. This greater mutual distance or spacing outside of the transfer or delivery region 13*a* makes it possible for the collating conveyors 8 to pass one another or move relative to one another undisturbed at both outermost lateral points (shown at the left and right sides of FIG. 4), i.e. prevents mutual interference of the draped or hanging printed signatures or sheets 16, 17 and 18.

As will be described hereinbelow, the collating conveyors 8 are rotated about their axes of rotation 34 during their revolution about the common axis of rotation 4*a* of the collating drum or cylinder 5 such that they substantially maintain their vertical position or upright orientation and their crowns or roof peaks 8*a* are continuously positioned substantially upright. Drive shafts 49 are pivotably mounted in the supporting or support elements 6 and 7 for this purpose. These drive shafts 49 are arranged around the axis of revolution 4*a*. Two sprockets or sprocket wheels 50 and 51 are located on these drive shafts 49 at the side of the support element 7. The sprockets or sprocket wheels 50 and 51 of each of the adjacent drive shafts 49 are interconnected by means of chains 52. The drive shafts 49 are divided into two mutually separate groups as can be seen with reference to FIG. 4. One of the two sprockets or sprocket wheels 50 or 51, located on those drive shafts designated by the reference numerals 49′ and 49″ is connected by means of a chain 53 with a sprocket or sprocket wheel 54. This sprocket or sprocket wheel 54 is stationary with respect to the common axis of rotation 4a, i.e. not rotating, and is arranged coaxial to the common axis of rotation 4a. The drive shafts 49' and 49'' are rotated by means of the circular travel or rotation of the chains 53 on the sprockets or sprocket wheels 54. This rotation is transmitted by means of the chains 52 to the drive shafts 49 of the associated groups of drive shafts 49.

Two sprockets or sprocket wheels 55 and 56 are located on the drive shafts 49. These two sprockets or sprocket wheels 55 and 56 are positioned on opposite sides or ends with respect to the collating conveyors 8 as will especially be seen with reference to FIG. 3. Chains 57 and 58 engage these respective sprockets or sprocket wheels 55 and 56. These chains 57 and 58 also engage sprockets or sprocket wheels 59 and 60, respectively. These sprockets or sprocket wheels 59 and 60 are positioned on the pivot or journal pivot or journal pin 37 of the substantially straight rocker arm or control lever 35. Adjacent to these sprockets or sprocket wheels 59 and 60 there are positioned on this pivot pin 37 additional sprockets or sprocket wheels 61 and 62, respectively. These sprockets or sprocket wheels 61 and 62 are drivingly connected by means of respective chains 63 and 64 with respective sprockets or sprocket wheels 65 and 66. These sprockets or sprocket wheels 65 and 66 are positioned on the respective pivot or journal pins 32 and 33. One respective end of each collating conveyor 8 is located in the associated substantially straight rocker arm or control lever 35 by means of the related pivot or journal pin 32 and 33 as the case may be. The driven connection from the drive shafts 49 to the collating conveyors 8 is thus made only by means of the substantially straight rocker arm or control lever 35 as can be seen in FIG. 3.

By means of the aforesaid drive arrangement or connection, the collating conveyors 8 are rotated in a counter-clockwise direction about their axes of rotation 34 during their revolution about the common axis of revolution 4a. In other words, the collating conveyors 8 are rotated in the direction of rotation I as shown in FIG. 4 such that they substantially maintain their vertical position or upright orientation.

The drive or drive means of the conveying arrangement of the collating conveyors 8 is preferably accomplished by means of the described relative rotation of the collating conveyors 8 with respect to the rocker arms or control levers 35 and 36, as is further described in the United States patent application (Ser. No. 877,359, now U.S. Pat. No. 4,684,116 previously referenced in this application and the disclosure of which is incorporated herein by reference. The advance or feed speed of the conveyor arrangement of the collating conveyors 8 is thus derived from the speed with which the collating conveyors 8 rotate about their axes of rotation 34. This speed of rotation of each collating conveyor 8, however, changes during the time in which the associated guide or control roller or follower 39 passes through the second section 46 and the third section 47 of the guide or control curves or cams 41 and 42. Accordingly, this also results in the advance or circulation speed of the conveyor arrangement of the collating conveyors 8 also being subject to a change, i.e. a deceleration and thereafter an acceleration, as the printed sheets or signatures 16, 17 and 18 pass through the respective second section 46 and third section 47 of the guide or control curves or cams 41 and 42. During conveyance or advancement of the printed signatures or sheets 16, 17 and 18 at a reduced circulation speed by means of the collating conveyors 8, preparation operations such as stitching, attaching a label and similar operations can be undertaken on these printed signatures or sheets.

Supplementary to the preceding description of the method of operating the collating apparatus 1, it will again be noted that it is the provision of alternating substantially straight rocker arms or control levers 35 with offset rocker arms or control levers 36 which makes possible the passage of the rocker arms or control levers 35 and 36 during the pivoting of these rocker arms or control levers 35 and 36 inwardly towards the common axis of revolution 4a. Substantially U-shaped recesses or clearances 48 which are radially open towards the outside are provided in the supporting or support elements 6 and 7. The arms 38 supporting the guide or control rolls or followers 39 of the rocker arms or control levers 35 and 36 can penetrate into these substantially U-shaped recesses or clearances 48 during the pivoting of these rocker arms or control levers 36 and 36 inwardly towards the common axis of revolution 4a as can be seen in reference to FIG. 4.

Several possible variant constructions of the inventive collating apparatus will be briefly described hereinbelow.

It will be understood that the infeed devices 13, 14 and 15 can not only transport individual printed signatures or sheets 16, 17 and 18 but can also transport several printed signatures or sheets folded within each other or interstuffed. In addition, printed signatures or sheets which have been folded in the center, that is to say which do not comprise a leading marginal lap, can also be processed. In this latter case, the opening of these printed signatures or sheets must occur in a somewhat different manner than in the manner described herein.

The principle of supporting and controlling the movement of the collating conveyors 8 with reference to a collating apparatus can also be utilized with a different type of apparatus for the transportation or conveyance of objects or products. In this case, in lieu of the collating conveyors 8, there are provided differently formed receiving elements, for example, platform conveyors for receiving the objects to be transported or conveyed.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for collating folded printed products, especially signatures, comprising:

a plurality of movable collating conveyors for conveying the folded printed products in straddling realtionship along respective substantially straight conveyor paths defined by said plurality of movable collating conveyors;

each of said movable collating conveyors having a predetermined direction of extent and being movable in said predetermined direction of extent for collating infed folded printed products;

each movable collating conveyor of said plurality of movable collating conveyors extending in spaced substantially parallel relationship to a common axis of revolution;

drive means for driving said plurality of movable collating conveyors in revolution about said common axis of revolution;

each said movable collating conveyor being spaced from each adjacent collating conveyor of said plurality of movable collating conveyors by a controllable separation distance; and control means for altering said controllable separation distance between said adjacent movable collating conveyors during revolution of said plurality of movable collating conveyors about said common axis of revolution.

2. The apparatus as defined in claim 1, wherein:

said control means comprise a plurality of rocker arms for supporting said plurality of movable collating conveyors;

rotatable means supporting a plurality of journal pins extending substantially parallel to said common axis of revolution for pivotably positioning said plurality of rocker arms on said plurality of journal pins and for circulatingly driving said plurality of rocker arms about said common axis of revolution; and said control means comprising a control arrangement for pivoting said plurality of rocker arms during revolution about said common axis of revolution.

3. The apparatus as defined in claim 2, wherein:

said rotatable means include means for moving said plurality of journal pins along a substantially circular path positioned substantially co-axial to said common axis of revolution; and said control means pivotably displacing said plurality of journal pins relative to said common axis of revolution.

4. The apparatus as defined in claim 2, wherein:

said rotatable means include common support means for supporting said plurality of rocker arms together with said plurality of journal pins at a respective substantially uniform radial distance from said common axis of revolution;

a shaft for supporting said common support means and defining said common axis of revolution; and said drive means being operatively connected with said shaft.

5. The apparatus as defined in claim 1, wherein:

said control means comprise a plurality of rocker arms for supporting said plurality of movable collating conveyors;

a plurality of journal pins extending substantially parallel to said common axis of revolution for pivotably supporting said plurality of rocker arms and for circulatingly driving said plurality of rocker arms about said common axis of revolution;

said control means comprising a control arrangement for pivoting said plurality of rocker arms; and said control arrangement comprising at least one control cam and at least one follower mounted on each rocker arm of said plurality or rocker arms and co-acting with said at least one control cam.

6. The apparatus as defined in claim 5, wherein:

said at least one control cam comprises substantially annular camming means.

7. The apparatus as defined in claim 5, wherein:

said at least one control cam comprises a first section, a second section and a third section;

said first section of said at least one control cam being substantially circularly arcuate and substantially co-axial to said common axis of revolution;

said common axis of revolution defining a direction of revolution;

said second section of said at least one control cam possessing a decreasing spacing from said common axis of revolution as seen in said direction of revolution; and said third section of said at least one control cam possessing an increasing spacing from said common axis of revolution as seen in said direction of revolution.

8. The apparatus as defined in claim 7, further including:

an infeed device for infeeding the folded printed products to said plurality of movable collating conveyors and having a transfer region; and said second section of said at least one control cam being located in said transfer region.

9. The apparatus as defined in claim 5, wherein:

said follower of each associated rocker arm of said plurality of rocker arms is positioned between an associated journal pin of said plurality of journal pins of each said associated rocker arm and an associated journal pin of an associated collating conveyor of said plurality of collating conveyors.

10. The apparatus as defined in claim 1, wherein:

each said movable collating conveyor comprises advancing means possessing a drive operated as a function of the rotational movement of each said movable collating conveyor about said axis of rotation.

11. The apparatus as defined in claim 1, further including:

a plurality of product feeding means arranged in spaced relationship axially along said common axis of revolution of said plurality of movable collating conveyors for infeeding folded printed products for collation to each of said plurality of said movable collating conveyors.

12. The apparatus as defined in claim 2, wherein:

said control arrangement comprises at least one control cam and a respective follower provided for each rocker arm of said plurality of rocker arms and co-acting with said at least one control cam.

13. An apparatus for collating folded printed products, especially signatures, comprising:

a plurality of collating conveyors for conveying the folded printed products in straddling relationship along respective substantially straight conveyor paths defined by said plurality of collating conveyors;

each collating conveyor of said plurality of collating conveyors extending in spaced substantially parallel relationship to a common axis of revolution;

drive means for driving said plurality of collating conveyors in revolution about said common axis of revolution;

each said collating conveyor being spaced from each adjacent collating conveyor of said plurality of collating conveyors by a controllable separation distance;

control means for altering said controllable separation distance between said adjacent collating conveyors during revolution of said plurality of collating conveyors about said common axis of revolution;

said control means comprise a plurality of rocker arms for supporting said plurality of collating conveyors;

rotatable means supporting a plurality of journal pins extending substantially parallel to said common axis of revolution for pivotably positioning said plurality of rocker arms on said plurality of journal pins and for circulatingly driving said plurality of rocker arms about said common axis of revolution;

said control means comprising a control arrangement for pivoting said plurality of rocker arms during revolution about said common axis of revolution;

said rotatable means including common support means for supporting said plurality of rocker arms together with said plurality of journal pins at a respective substantially uniform radial distance from said common axis of revolution;

a shaft for supporting said common support means and defining said common axis of revolution;

said drive means being operatively connected with said shaft;

said common support means being defined by two support elements located in mutual spaced relationship on said shaft; and said plurality of journal pins of said plurality of rocker arms being positioned on said two support elements.

14. An apparatus for collating folded printed products, especially signatures, comprising:

a plurality of collating conveyors for conveying the folded printed products in straddling relationship along respective substantially straight conveyor paths defined by said plurality of collating conveyors;

each collating conveyor of said plurality of collating conveyors extending in spaced substantially parallel relationship to a common axis of revolution;

drive means for driving said plurality of collating conveyors in revolution about said common axis of revolution;

each said collating conveyor being spaced from each adjacent collating conveyor of said plurality of collating conveyors by a controllable separation distance;

control means for altering said controllable separation distance between said adjacent collating conveyors during revolution of said plurality of collating conveyors about said common axis of revolution;

said control means comprise a plurality of rocker arms for supporting said plurality of collating conveyors;

a plurality of journal pins extending substantially parallel to said common axis of revolution for pivotably supporting said plurality of rocker arms and for circulatingly driving said plurality of rocker arms about said common axis of revolution;

said control means comprising a control arrangement for pivoting said plurality of rocker arms;

said control arrangement at least one control cam and at least one follower mounted on each rocker arm of said plurality of rocker arms and co-acting with said at least one control cam;

each said collating conveyor being mounted at each end in an associated one of said plurality of rocker arms; and said at least one control cam comprising two control cams which are substantially identical and confrontingly positioned at opposite ends of said plurality of collating conveyors.

15. An apparatus for collating folded printed products, especially signatures, comprising:

a plurality of collating conveyors for conveying the folded printed products in straddling relationship along respective substantially straight conveyor paths defined by said plurality of collating conveyors;

each collating conveyor of said plurality of collating conveyors extending in spaced substantially parallel relationship to a common axis of revolution;

drive means for driving said plurality of collating conveyors in revolution about said common axis of revolution;

each said collating conveyor being spaced from each adajcent collating conveyor of said plurality of collating conveyors by a controllable separation distance;

control means for altering said controllable separation distance between said adjacent collating conveyors during revolution of said plurality of collating conveyors about said common axis of revolution;

said control means comprising a plurality of rocker arms for supporting said plurality of collating conveyors;

a plurality of journal pins extending substantially parallel to said common axis of revolution for pivotably supporting said plurality of rocker arms and for circulatingly driving said plurality of rocker arms about said common axis of revolution;

said control means comprising a control arrangement for pivoting said plurality of rocker arms;

said control arrangement comprising at least one control cam and at least one follower mounted on each rocker arm of said plurality or rocker arms and co-acting with said at least one control cam;

said plurality of rocker arms containing alternatingly arranged rocker arms situated on the same ends of said plurality of collating conveyors;

said alternatingly arranged rocker arms of said plurality of rocker arms situated on the same ends of said plurality of collating conveyors have a substantially offset shape; and each rocker arm of said plurality of rocker arms positioned between said alternatingly arranged and substantially offset rocker arms having a substantially straight shape.

16. The apparatus as defined in claim 15, wherein:

each collating conveyor of said plurality of said collating conveyors is supported on one side of the apparatus for collating folded printed products by an associated one of said substantially straight rocker arms and on the other side by an associated one of said substantially offset rocker arms.

17. An apparatus for collating folded printed products, especially signatures, comprising:

a plurality of collating conveyors for conveying the folded printed products in straddling relationship along respective substantially straight conveyor paths defined by said plurality of collating conveyors;

each collating conveyor of said plurality of collating conveyors extending in spaced substantially parallel relationship to a common axis of revolution;

drive means for driving said plurality of collating conveyors in revolution about said common axis of revolution;

each said collating conveyor being spaced from each adjacent collating conveyor of said plurality of collating conveyors by a controllable separation distance;

control means for altering said controllable separation distance between said adjacent collating conveyors during revolution of said plurality of collating conveyors about said common axis of revolution;

each said collating conveyor having an axis of rotation located substantially parallel to said common axis of revolution of said plurality of collating conveyors and being rotatable about said axis of rotation; and means for rotating each said collating conveyor about said axis of rotation during revolution about said common axis of revolution such that each said collating conveyor maintains a substantially upright position.

18. An apparatus for collating folded printed products, especially signatures, comprising:

a plurality of collating conveyors for conveying the folded printed products in straddling relationship along respective substantially straight conveyor paths defined by said plurality of collating conveyors;

each collating conveyor of said plurality of collating conveyors extending in spaced substantially parallel relationship to a common axis of revolution;

drive means for driving said plurality of collating conveyors in revolution about said common axis of revolution;

each said collating conveyor being spaced from each adjacent collating conveyor of said plurality of collating conveyors by a controllable separation distance;

control means for altering said controllable separation distance between said adjacent collating conveyors during revolution of said plurality of collating conveyors about said common axis of revolution;

said control means comprising a plurality of rocker arms for supporting said plurality of collating conveyors;

rotatable means supporting a plurality of journal pins extending substantially parallel to said common axis of revolution for pivotably positioning said plurality of rocker arms on said plurality of journal pins and for circulatingly driving said plurality of rocker arms about said common axis of revolution;

said control means comprising a control arrangement for pivoting said plurality of rocker arms during revolution about said common axis of revolution;

said rotatable means including common support means for supporting said plurality of rocker arms together with said plurality of journal pins at a respective substantially uniform radial distance from said common axis of revolution;

a shaft for supporting said common support means and defining said common axis of revolution;

said drive means being operatively connected with said shaft;

each said collating conveyor having an axis of rotation located substantially parallel to said common axis of revolution of said plurality of collating conveyors and being rotatable about said axis of rotation;

means for rotating each said collating conveyor about said axis of rotation during revolution about said common axis of revolution such that each said collating conveyor maintains a substantially upright position;

a drive arrangement comprising a plurality of drive members cooperating with said plurality of collating conveyors;

said plurality of collating conveyors being rotatably positioned in said plurality of rocker arms and provided with said plurality of drive members;

said drive arrangement further comprising a drive element;

a drive component arranged co-axial to said common axis of revolution of said plurality of collating conveyors; and said drive component operatively engaging said plurality of drive members by means of said drive element.

19. The apparatus as defined in claim 18, wherein:

said plurality of drive members comprises a plurality of sprockets.

20. The apparatus as defined in claim 18, wherein:

said drive element comprises a drive chain.

21. The apparatus as defined in claim 18, wherein:

said drive component comprises a sprocket wheel; and said drive component being fixed against rotation.

22. The apparatus as defined in claim 21, further including:

a plurality of drive shafts rotatably positioned in said common support means and arranged about said common axis of revolution and connected by means of said plurality of drive members with said co-axially mounted drive component; and said plurality of drive shafts being in drive engagement with an associated drive member of said plurality of drive members of at least one said collating conveyor.

23. The apparatus as defined in claim 22, wherein:

said drive element comprises a drive chain.

24. The apparatus as defined in claim 18, further including:

a plurality of drive shafts rotatably positioned in said common support means and arranged about said common axis of revolution and each one of said plurality of drive shafts being connected by means of said plurality of drive members with another one of said plurality of drive shafts; and said plurality of drive shafts being in drive engagement with an associated drive member of said plurality of drive members of at least one said collating conveyor.

25. The apparatus as defined in claim 18, wherein:

said control means comprise a plurality of rocker arms for supporting said plurality of collating conveyors;

predetermined ones of said plurality of rocker arms defining substantially straight rocker arms; and each drive member of said plurality of drive members of each collating conveyor of said plurality of collating conveyors being arranged on a side of said plurality of said collating conveyors where there is located said substantially straight rocker arm of said plurality of rocker arms.

26. An apparatus for conveying objects, comprising:

a plurality of driven elements mutually separated by a predetermined distance and arranged about a common axis of revolution and circulatingly driven about said common axis of revolution for receiving the objects to be conveyed;

means for circulatingly driving said plurality of driven elements about said common axis of revolution; and control means provided for positively and selectively variably altering said predetermined distance between adjacent ones of said plurality of driven elements during revolution about said common axis of revolution.

* * * * *

UNITED STATES PATENT AND TRADEMARK OFFICE

CERTIFICATE OF CORRECTION

PATENT NO. : 4,732,374

DATED : March 22, 1988

INVENTOR(S) : WERNER HONEGGER

It is certified that error appears in the above-identified patent and that said Letters Patent is hereby corrected as shown below:

Column 7, line 14, after "revolution" please delete "of" and insert --or--

Column 7, line 53,after "pivoted" please delete "in" and insert --or--

Column 7, line 55, please delete "dispalcement" and insert --displacement--

Column 8, line 10, at the beginning of the line please delete "taneosuly" and insert --taneously--

Column 9, line 20, please delete "or journal pivot"

Column 9, line 34, before "connection" please delete "driven" and insert --drive--

Column 9, line 51, after "application" please delete "(Ser." and insert --Ser.--

Column 10, line 23, after "levers" please delete "36" and insert --35--

Column 13, line 60, after "arrangement" please insert --comprising--

Signed and Sealed this

Sixteenth Day of August, 1988

*Attest:*

DONALD J. QUIGG

*Attesting Officer*

*Commissioner of Patents and Trademarks*